US007585164B2

(12) United States Patent
Joo et al.

(10) Patent No.: US 7,585,164 B2
(45) Date of Patent: Sep. 8, 2009

(54) BACKFLOW PREVENTING APPARATUS FOR COMPRESSOR

(75) Inventors: Young-Se Joo, Gyeongsangnam-Do (KR); Na-Ra Han, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 62 days.

(21) Appl. No.: 11/783,065

(22) Filed: Apr. 5, 2007

(65) Prior Publication Data

US 2007/0237664 A1 Oct. 11, 2007

(30) Foreign Application Priority Data

Apr. 6, 2006 (KR) ..... 10-2006-0031625
Aug. 28, 2006 (KR) ..... 10-2006-0081978
Feb. 15, 2007 (KR) ..... 10-2007-0016229

(51) Int. Cl.
*F01C 27/00* (2006.01)
*F03C 2/00* (2006.01)
*F03C 4/00* (2006.01)
*F04C 15/00* (2006.01)

(52) U.S. Cl. ..... 418/270; 418/55.1; 417/310; 137/527.4; 137/527.6; 137/527.8

(58) Field of Classification Search ..... 418/55.1–55.6, 418/57, 270; 137/527.4, 527.6, 527.8; 417/310
See application file for complete search history.

(56) References Cited

U.S. PATENT DOCUMENTS 3,366,137 A * 1/1968 Hansen ..... 137/527.4
4,128,111 A * 12/1978 Hansen et al. ..... 137/527.8
5,088,905 A * 2/1992 Beagle ..... 418/55.1
5,141,420 A * 8/1992 Nambiar ..... 418/55.1
5,496,160 A 3/1996 Richardson, Jr. et al.
5,683,236 A 11/1997 Harrison et al.
6,171,084 B1 * 1/2001 Wallis et al. ..... 418/55.1
6,264,452 B1 * 7/2001 Sun et al. ..... 418/55.1
6,428,292 B1 * 8/2002 Wallis et al. ..... 418/55.1
6,659,735 B2 * 12/2003 Kim ..... 417/310
7,182,586 B2 * 2/2007 Kim et al. ..... 418/55.1

FOREIGN PATENT DOCUMENTS

JP 62-265487 11/1987

OTHER PUBLICATIONS

Written Opinion of the International Search Report.

* cited by examiner

*Primary Examiner*—Theresa Trieu
(74) *Attorney, Agent, or Firm*—KED & Associates LLP

(57) ABSTRACT

A backflow preventing apparatus for a scroll compressor is disclosed, in which a check valve is hinge-coupled to a valve seat, or is coupled to a valve seat so as to be elastically opened and closed. The check valve is opened and closed by a pressure difference and its own weight or elasticity, thereby having a quick response speed. The check valve prevents discharged refrigerant from backflowing, thus enhancing efficiency of the compressor. Further, since the check valve when opened is prevented from colliding with a valve housing by a valve stopping surface or a retainer, discharge noise from the compressor is reduced.

28 Claims, 10 Drawing Sheets

BACKFLOW PREVENTING APPARATUS FOR COMPRESSOR

RELATED APPLICATION

The present application claims priority to Korean Application No. 10-2006-0031625, filed on Apr. 6, 2006, Korean Application No. 10-2006-0081978, filed in Korea on Aug. 28, 2006, and Korean Application No. 10-2007-0016229, filed in Korea on Feb. 15, 2007, all of which are herein expressly incorporated by reference in their entirety.

BACKGROUND

1. Field

A compressor, and more particularly, a backflow preventing apparatus for a compressor are disclosed herein.

2. Background

Generally, a compressor serves to compress a refrigerant at a low pressure into a refrigerant at a high pressure. The compressor may include a driving motor that generates a driving force at an inner space of a hermetic casing, and a compression part that compresses a refrigerant using the driving force received from the driving motor. The compressor may be classified into, for example, a reciprocating compressor, a rotary compressor, a scroll compressor, or a centrifugal compressor, according to the method of compressing the refrigerant. However, the compressor may have degraded function or may be damaged when a discharged refrigerant backflows into the inner space of the casing. Accordingly, a backflow preventing apparatus, including a backflow preventing valve is provided to prevent discharged refrigerant from backflowing into the casing. However, the conventional backflow preventing apparatus have various problems.

BRIEF DESCRIPTION OF THE DRAWINGS

Embodiments will be described in detail with reference to the following drawings in which like reference numerals refer to like elements wherein.

DETAILED DESCRIPTION

Reference will now be made in detail to embodiments, examples of which are illustrated in the accompanying drawings. The backflow preventing apparatus according to embodiments is shown implemented in both a low pressure type scroll compressor and a high pressure type scroll compressor; however, the backflow preventing apparatus according to embodiments may implemented in other types of compressors as well.

A scroll compressor having a backflow preventing apparatus according to an embodiment will be explained hereinafter. Scroll compressors are widely applied to, for example, air conditioning systems due to their high efficiency and low noise output. A scroll compressor may include a driving motor and a compression part at an inner space of a casing, the compression part including compression chambers formed by two scrolls engaged with each other. In the scroll compressor, a refrigerant is respectively sucked into a pair of compression chambers that are formed by a wrap of an orbiting scroll engaged with a wrap of a fixed scroll. While the refrigerant sucked into the respective compression chambers moves along an orbit of the orbiting scroll, it is compressed and then discharged to the inner space of the casing at a final compression chamber.

Figure 1:
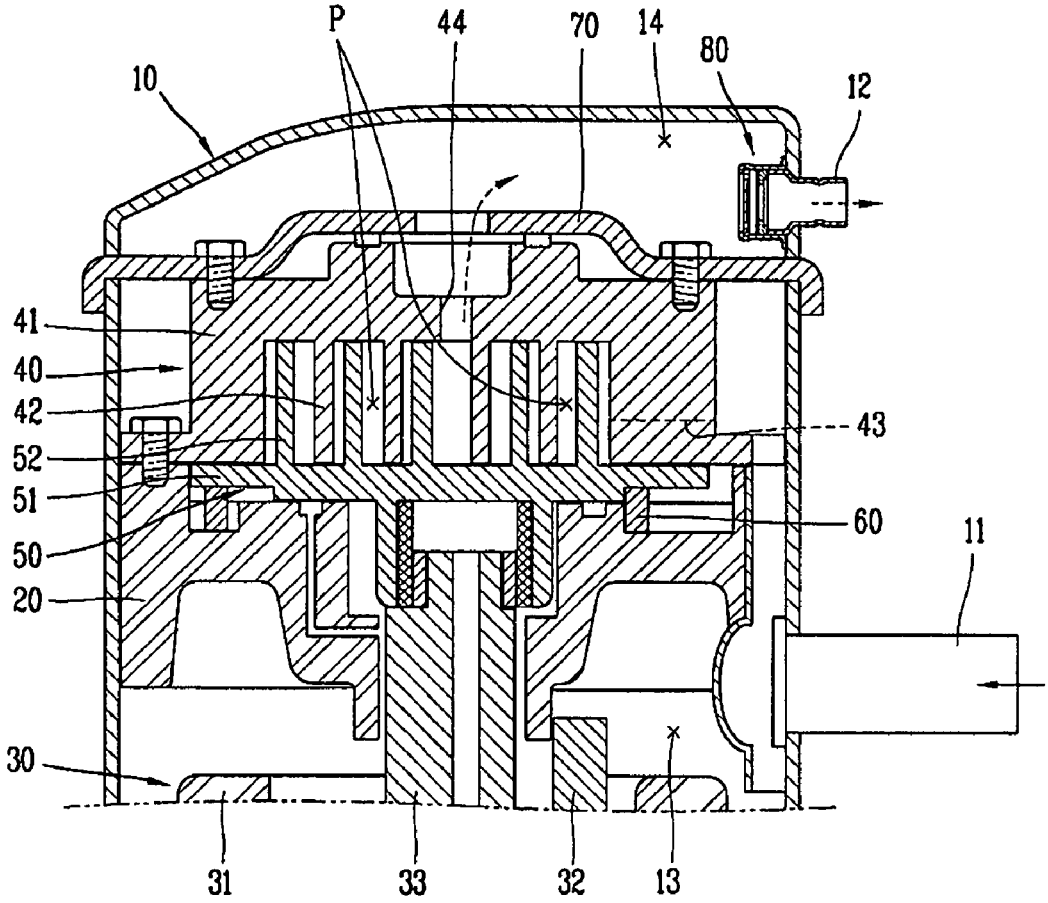
FIG. 1 is a longitudinal sectional view of a scroll compressor in accordance with an embodiment.

FIG. 1 discloses a scroll compressor according to one embodiment, which includes a casing 10 to which a suction pipe 11 and a discharge pipe 12 are connected, a main frame 20 and a sub frame (not shown) fixed to upper and lower sides of an inner circumferential surface of the casing 10, a driving motor 30 with stator 31 disposed between the main frame 20 and the sub frame that generates a rotation force, a fixed scroll 40 fixed to an upper surface of the main frame 20 and having an involute wrap 42 at a lower surface of a plate 41, an orbiting scroll 50 having an involute wrap 52 at an upper surface of a plate 51 that performs an orbiting motion by being engaged with the involute wrap 42 of the fixed scroll 40 so that a plurality of compression chambers are formed, an Oldham's ring 60 disposed between the orbiting scroll 50 and the main frame 20 that orbits the orbiting scroll 50 while preventing the orbiting scroll 50 from rotating, a high-low pressure separating plate 70 coupled to a rear surface of the fixed scroll 40 that divides an inner space of the casing 10 into a suction space 13 and a discharge space 14, and a backflow preventing apparatus 80 disposed at an outlet of the discharge space 14 that prevents compression gas discharged to the discharge pipe 12 from backflowing.

In the scroll compressor of FIG. 1, when power is supplied to the driving motor 30, a driving shaft 33 of the driving motor 30 is rotated together with a rotor 32. Accordingly, the orbiting scroll 50 performs an eccentric orbiting motion on an upper surface of the main frame 20 via the Oldham's ring 60, thereby forming a pair of compression chambers P that consecutively move between the orbiting wrap 52 and the fixed wrap 42. At the same time, as the orbiting scroll 50 continuously performs an orbiting motion, a refrigerant is sucked into an outermost compression chamber through an inlet 43 of the fixed scroll 40. While the refrigerant moves to a center of a scroll along an orbit of the orbiting scroll 50, it is compressed and is discharged into the discharge space 14 of the casing 10 through a discharge port 44 of the fixed scroll 40 at the final compression chamber. Then, the refrigerant is discharged, for example, to a condenser of a refrigerating cycle provided in an air conditioning system through the discharge pipe 12 thus to circulate the refrigerant through the refrigerating cycle.

When the compressor is stopped, a pressure of the discharge space 14 is lower than that of the discharge pipe 12. As a result, the refrigerant discharged to the discharge pipe 12 may backflow into the discharge space 14. However, since a backflow preventing apparatus 80 is disposed at the outlet of the discharge space 14, the refrigerant having been discharged to the discharge pipe 12 is prevented from backflowing into the discharge space 14 due to the pressure difference.

Examples of backflow preventing apparatus provided in the outlet of the discharge space have been disclosed, for example, in the U.S. Pat. No. 5,141,420, No. 6,171,084, and No. 6,428,292. The backflow preventing apparatus of FIG. 1 is configured so that a check valve serves to open and close a space between the discharge space and the discharge pipe due to a pressure difference. The backflow preventing apparatus of FIG. 1 will be explained in more detail with reference to FIGS. 2 and 3.

Figure 2:
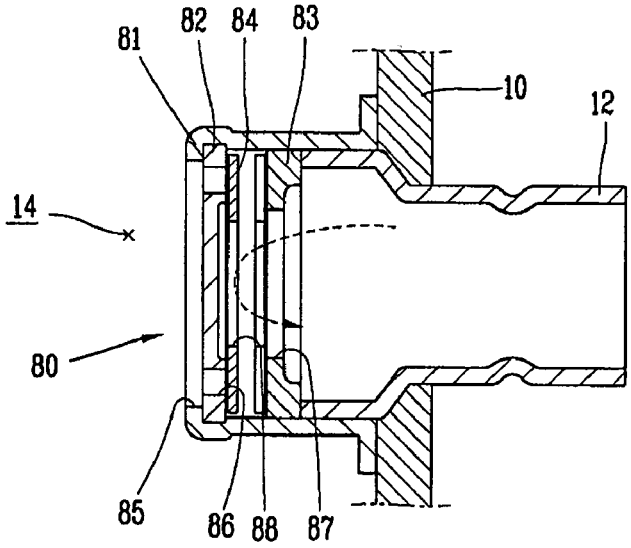
FIG. 2 is a longitudinal sectional view of a backflow preventing apparatus of FIG. 1 according to an embodiment.

Referring to FIG. 2, the backflow preventing apparatus 80 includes a housing 81 having a first refrigerant passing hole 85 through which the discharge space 14 and the discharge pipe 12 of the casing 10 communicate with one another, and fixedly-coupled to an inner circumferential surface of the casing 10; a valve seat 82 fixedly-coupled to an entrance of the housing 81 and having a second refrigerant passing hole 86 at an edge thereof; a stop 83 fixedly-coupled to an exit of the housing 81 and having a third refrigerant passing hole 87 at a center thereof; and a check valve 84 formed, for example, of a thin plate so as to freely move between the valve seat 82 and the stop 83 and having a fourth refrigerant passing hole 88 at a center thereof, that opens and closes the second refrigerant passing hole 86 of the valve seat 82.

The backflow preventing apparatus 80 allows a refrigerant to be smoothly discharged and prevents a refrigerant from backflowing by opening and closing the second refrigerant passing hole 86 of the valve seat 82 according to an operation state of the compressor. When the compressor is normally operated, since a pressure of the discharge space 14 is higher than that of the discharge pipe 12, the check valve 84 is pushed to the stop 83 due to the pressure difference. Since the second refrigerant passing hole 86 of the valve seat 82 is opened, the refrigerant discharged to the discharge space 14 is discharged to the discharge pipe 12. However, when the compressor is stopped, since the pressure of the discharge space 14 is lower than that of the discharge pipe 12, the check valve 84 is pushed to the valve seat 82 due to the pressure difference. As the second refrigerant passing hole 86 of the valve seat 82 is closed, the refrigerant discharged to the discharge pipe 12 is prevented from backflowing into the discharge pipe 14.

Figure 3:
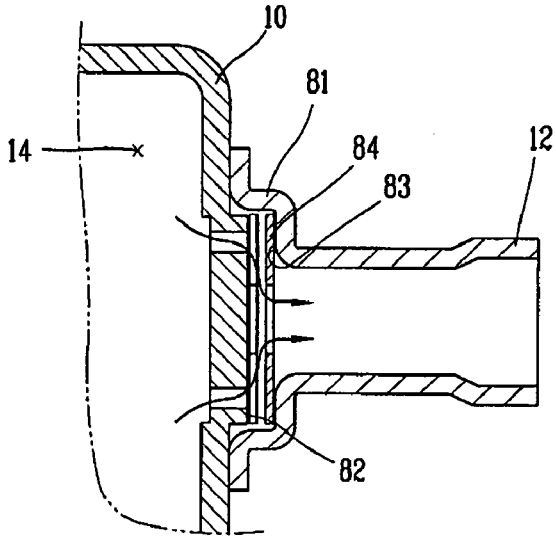
FIG. 3 is a longitudinal sectional view of a backflow preventing apparatus of FIG. 1 according to another embodiment.
Figure 4:
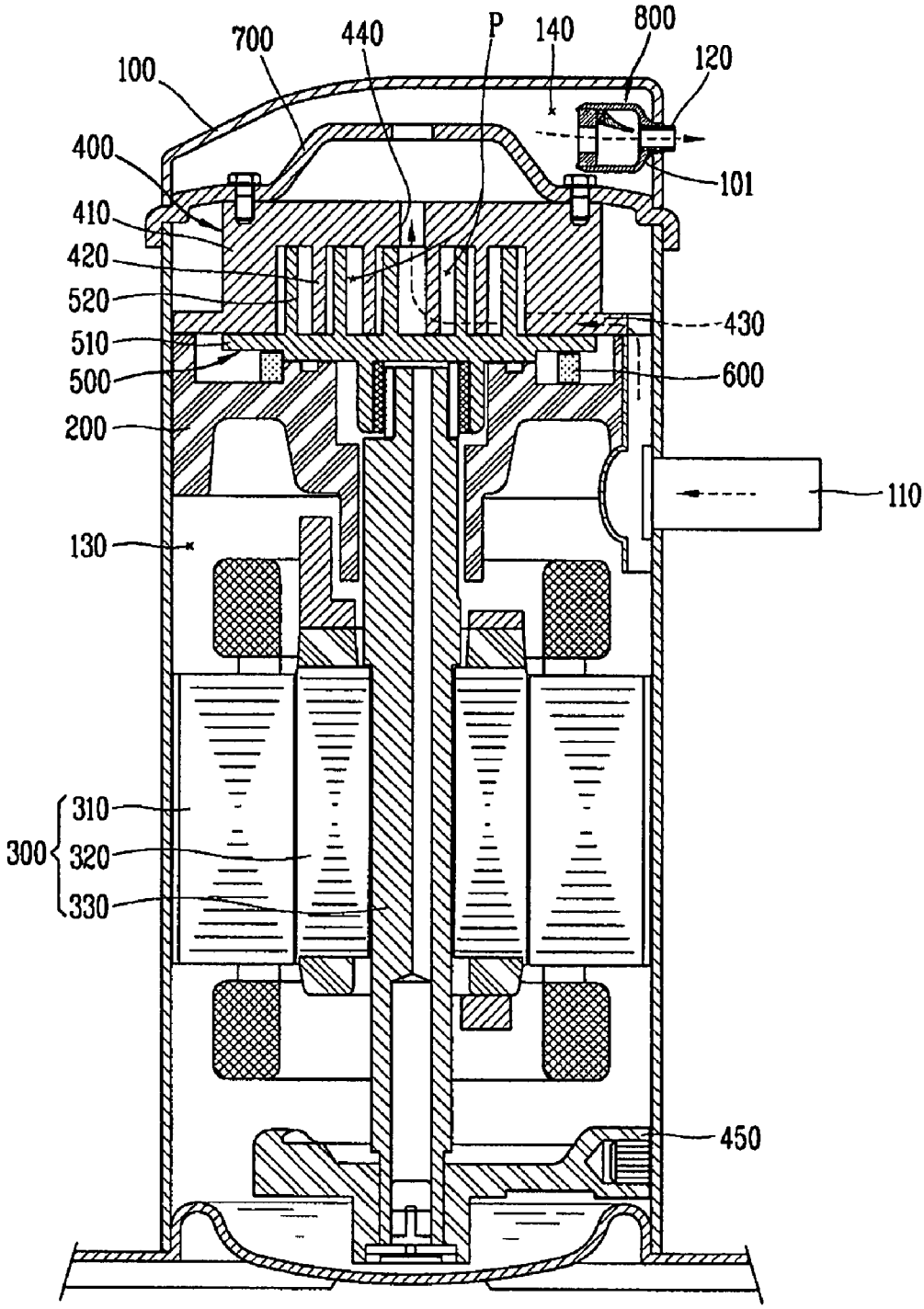
FIG. 4 is a longitudinal sectional view of a low pressure type scroll compressor having a backflow preventing apparatus according to another embodiment.

Referring to FIG. 3, in the backflow preventing apparatus 80, an entrance of the discharge pipe 12 is stepped without having the housing, the stop, and the valve seat, thereby forming the housing 81 for receiving the check valve 84 and the stop 83. Also, the valve seat 82 is formed at an outer surface of the casing 10 received in the entrance of the discharge pipe 12. Herein, the check valve 84 opens and closes a space between the discharge space 14 and the discharge pipe 12 freely moving due to a pressure difference.

However, the backflow preventing apparatus shown in FIG. 1-3 has the following problems. Since the check valve 84 moves only due to the pressure difference, it has a low responsive characteristic and a delayed closing speed. As a result, the refrigerant discharged to the discharge pipe 12 backflows, and a performance of the compressor is lowered. Further, the check valve 84 collides with the valve seat 82 when closed, and collides with the stop 83 when opened, thereby causing collision noise at the check valve and vibration noise for the compressor.

Hereinafter, a backflow preventing apparatus according to another embodiment will be explained in more detail herein below.

FIGS. 4 to 8B are views of a backflow preventing apparatus according another embodiment implemented in a scroll compressor. The scroll compressor of FIG. 4 may include a casing 100 to which a suction pipe 110 and a discharge pipe 120 are connected; a main frame 200 fixed to the inside of the casing 100; a driving motor 300 fixed to the inside of the casing 100 that generates a driving force; a fixed scroll 400 fixed to an upper surface of the main frame 200; an orbiting scroll 500 disposed on an upper surface of the main frame 200 and eccentrically coupled to a driving shaft 330 of the driving motor 300, forming a pair of compression chambers P and performing an orbiting motion by being engaged with the fixed scroll 400; an Oldham's ring 600 disposed between the orbiting scroll 500 and the main frame 200, that causes the orbiting scroll 500 to orbit while preventing the orbiting scroll 500 from rotating; a high-low pressure separating plate 700 that divides an inner space of the casing 100 into a suction space 130 and a discharge space 140; and a backflow preventing apparatus 800 inserted into the discharge space 140 of the casing 100, having an entrance connected to the casing 100, and having an exit connected to the discharge pipe 120, that prevents a refrigerant discharged to the discharge pipe 120 from backflowing into the discharge space 140 of the casing 100.

The suction pipe 110 may be connected to the suction space 130 of the casing 100, and the discharge pipe 120 may be connected to the discharge space 140 of the casing 100. The discharge pipe 120 may be insertion-coupled to a valve housing 810 of the backflow preventing apparatus 800, thereby connected to the discharge space 140.

An involute wrap 420 of the fixed scroll 400 and an orbiting wrap 520 of the orbiting scroll 500 may be disposed on plates 410 and 510, respectively. The involute wrap 420 of the fixed scroll 400 and an orbiting wrap 520 of the orbiting scroll 500 may be engaged with each other, thereby forming a pair of compression chambers P that consecutively move. An inlet 430 through which an outermost compression chamber communicates with the suction space 130 of the casing 100 may be disposed at one lower edge of the fixed scroll 400. An outlet 440 with which the discharge space 140 of the casing 100 communicates at a final compression chamber may be disposed at a middle portion of the fixed scroll 400. A check valve (not shown) that prevents the refrigerant discharged to the discharge space 140 of the casing 100 from backflowing into the compression chamber P may be disposed at an exit of the outlet 440.

The high-low pressure separating plate 700 may be formed as a ring-shaped plate having a predetermined width so that an inner circumferential surface thereof may be coupled to an upper surface of the fixed scroll 400 and an outer circumferential surface thereof may be coupled to the casing 100. Reference numeral 310 denotes a stator, 320 denotes a rotor, and 450 denotes a sub frame.

Figure 5:
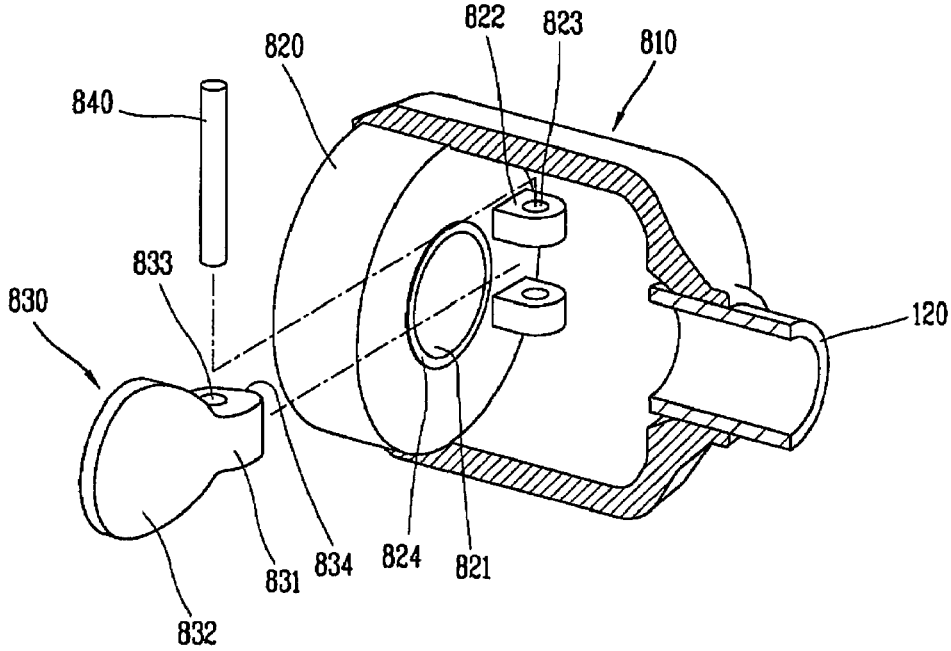
FIG. 5 is an exploded perspective view of a valve seat of the backflow preventing apparatus of FIG. 4 according to an embodiment.
Figure 6:
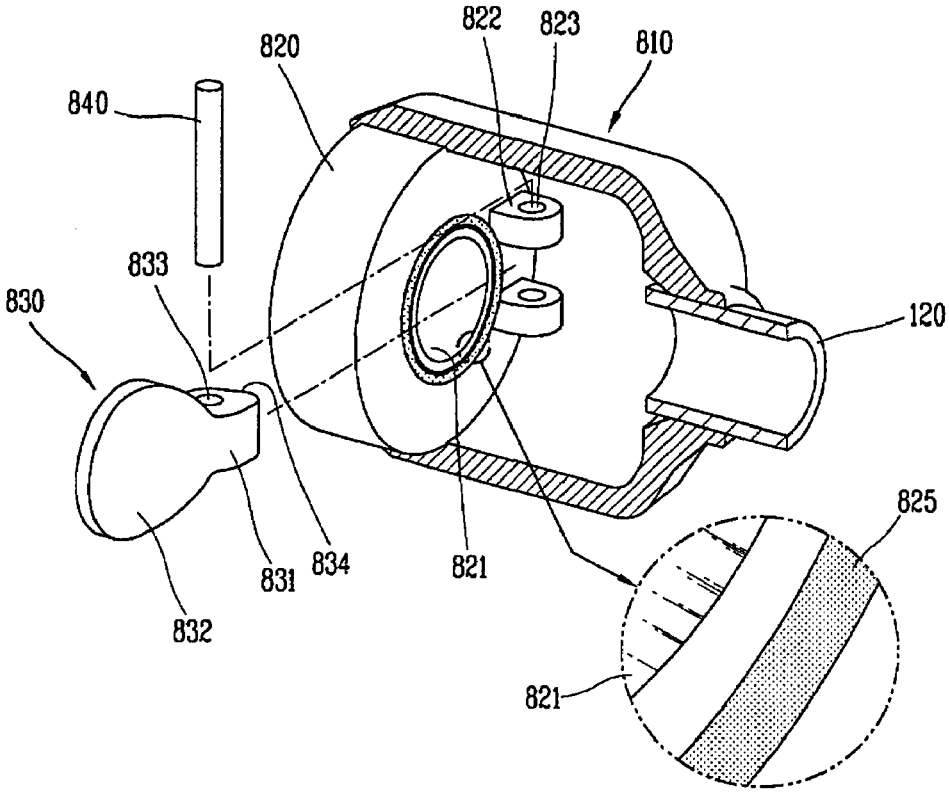
FIG. 6 is an exploded perspective view of a valve seat of the backflow preventing apparatus of FIG. 4 according to another embodiment.
Figure 7:
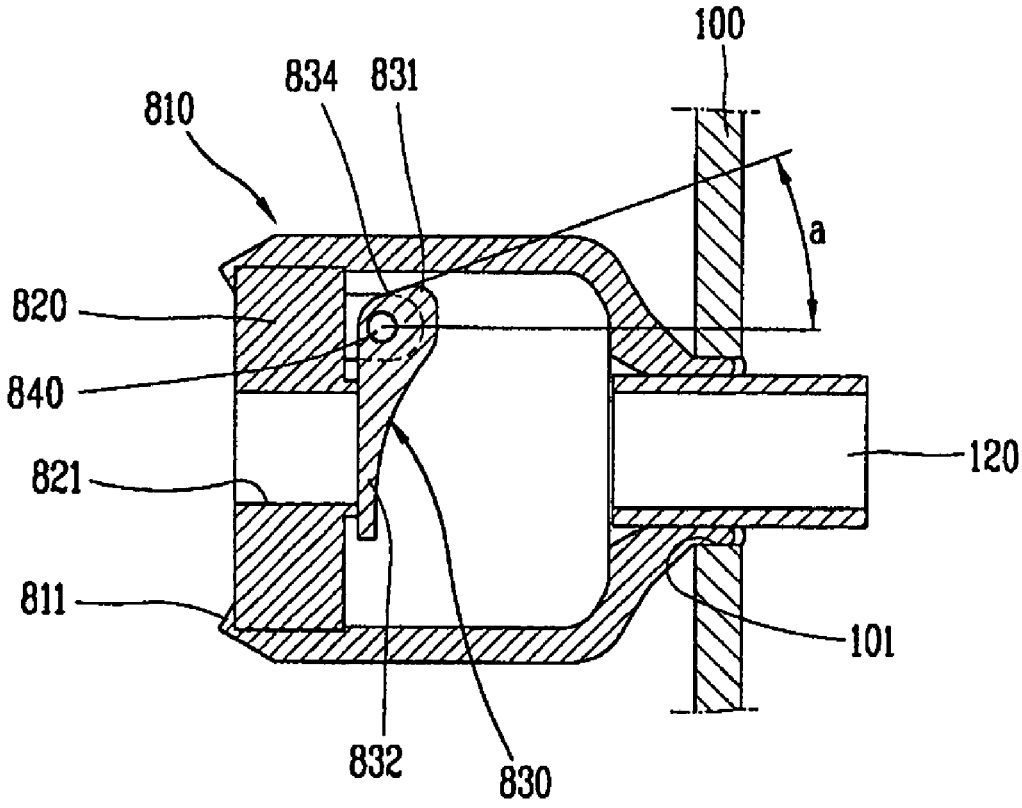
FIG. 7 is a longitudinal sectional view showing an assembled state of the backflow preventing apparatus of FIG. 4.

As shown in FIGS. 5 to 7, the backflow preventing apparatus 800 may include a valve housing 810 adhered to an inner wall surface of the casing 100, a valve seat 820 fixed to the inside of the valve housing 810 and having a refrigerant passing hole 821 at a center thereof, and a check valve 830 rotatably disposed on the valve seat 820 so as to open and close the refrigerant passing hole 821 of the valve seat 820 by being rotated that prevents a discharged refrigerant from backflowing.

The valve housing 810 may be disposed in the discharge space 140 of the casing 100, and both ends thereof may be opened so that the discharge space 140 and the discharge pipe 120 can may communicate with each other. One of the ends of the valve housing 810 may have a tapered cylindrical shape to which the discharge pipe 120 may be connected. The tapered portion may be partially inserted into a through hole 101 of the casing 100, and may be coupled thereto by, for example, welding. The valve housing 810 may be integrally coupled to the end of the tapered portion so that the valve housing 810 and discharge pipe 120 constitute one module. Accordingly, when the valve housing 810 is coupled to the casing 100, the discharge pipe 120 may be coupled thereto together therewith.

The valve housing 810 may have a seat supporting portion 811 that supports the valve seat 820. The seat supporting portion 811 may be formed by being protruded from an inner circumferential surface of the valve housing 810, or by contracting both ends of an entrance of the valve housing 810.

The valve seat 820 may have a ring shape having the first refrigerant passing hole 821 at a center thereof. The valve seat 820 may be forcibly inserted into the valve housing 810, or may be fixed to the valve housing 810, such as by welding or a by a bolt. The valve seat 820 may be integrally formed in the valve housing 810.

The valve seat 820 may have hinge protrusions 822 for inserting a hinge portion 831 of the check valve 830 and rotating the hinge portion 831, at right and left upper portions. A side hinge hole 823 for inserting a hinge pin 840 may be formed at a center of the hinge protrusion 822 in correspondence to a side hinge hole 833 of the check valve 830. The side hinge hole 823 may be formed on the same vertical line as a front end of the valve seat 820, or may be disposed at a discharge side so that the check valve 830 may be smoothly closed by a pressure difference and its weight.

As shown in FIG. 5, a sealing protrusion 824 may be formed near the refrigerant passing hole 821 so that a front end of the valve seat 820 may be in linear contact with a compression surface of the check valve 830. However, as shown in FIG. 6, a buffering member 825 may be disposed so that a refrigerant may be prevented from leaking between the check valve 830 and the valve seat 820 when the check valve 830 is closed, and so that an impact due to collision of the check valve 830 with another component may be buffered. The buffering member 825 may be formed to have a circular section so as to be in linear-contact with the check valve 830. The buffering member 825 may be disposed at the compression surface of the check valve 830.

As shown in FIGS. 5 to 7, the check valve 830 may have a hinge portion 831 configured to be hinge-coupled to the valve seat 820 at one end thereof, and an opening/closing portion 832 for opening and closing the refrigerant passing hole 821 of the valve seat 820 at another end thereof. The opening/closing portion 832 may have a disc shape. Further, the check valve 830 may be formed to be thicker towards the opening/closing portion 832 from the hinge portion 831 so as to be quickly opened.

Figure 9:
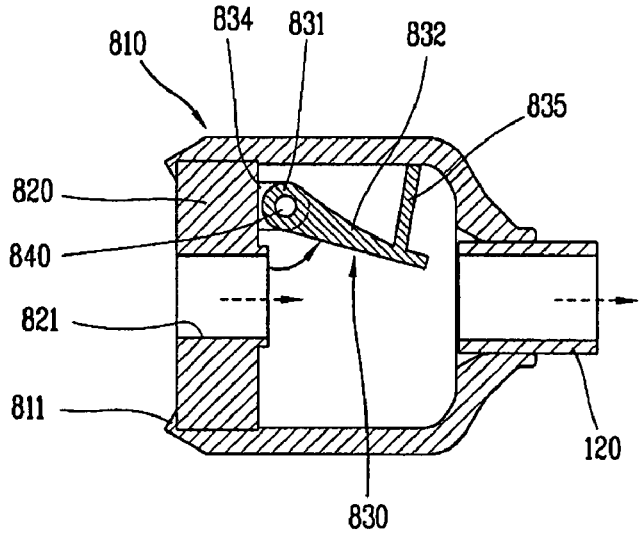
FIG. 9 is a longitudinal sectional view showing an assembled state of the backflow preventing apparatus according to another embodiment.

The side hinge hole 833 may be formed at a center of the hinge portion 831 in correspondence to the side hinge hole 823 of the valve seat 820. The side hinge hole 833 may be formed on the same vertical line as the compression surface of the check valve 830, or may be disposed at a discharge side so that the check valve 830 may be smoothly closed by a pressure difference and its weight. The check valve 830 may have a valve stopping surface 834 inclined at a certain angle for limiting an opened angle of the check valve 830 being opened when an outer circumferential surface of the hinge portion 831 comes into contact with the valve seat 820. As shown in FIG. 9, a valve stopping protrusion 835 for limiting an opened angle of the check valve 830 by coming into contact with an inner circumferential surface of the valve housing 810 may be disposed at a compression rear surface of the opening/closing portion 832.

The check valve 830 may be formed of a thin metallic plate with consideration to rigidity and elasticity, or may be formed of an engineered plastic material, such as peek, with consideration to noise and cost.

Figure 10:
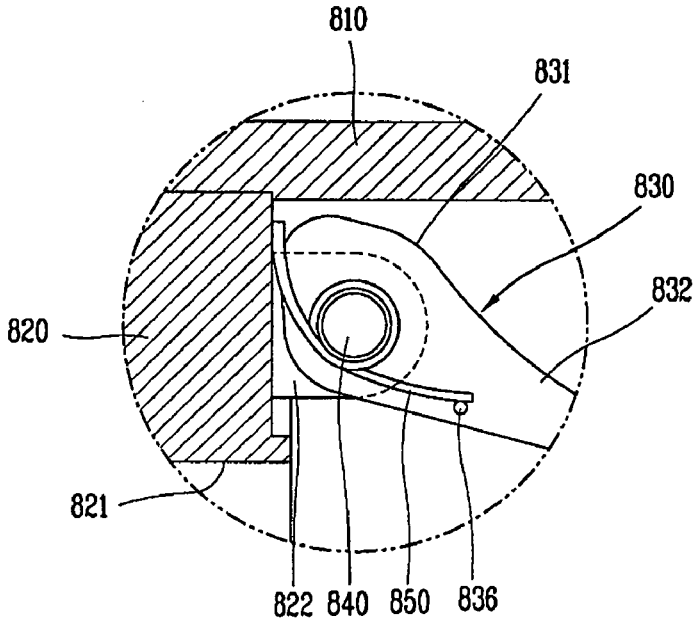
FIG. 10 is a longitudinal sectional view showing a state in which an elastic member is provided at a check valve of the backflow preventing apparatus of FIG. 4.

As shown in FIG. 10, an elastic member 850, such as a torsion spring, for accumulating an elastic force when the check valve 830 is opened and being restored when the check valve 830 is closed may be installed between the check valve 830 and the valve seat 820. Reference numeral 836 denotes a spring supporting protrusion. Refrigerant backflow may be effectively prevented by enhancing a closing speed of the check valve 830.

Operation and effect of the backflow preventing apparatus according to an embodiment will be explained herein below.

When power is supplied to the driving motor 300, the driving shaft 330 rotates, causing the orbiting scroll 500 coupled to the driving shaft 330 to eccentrically orbit by being engaged with the fixed scroll 400. When the orbiting scroll 500 progressively moves within the fixed scroll 400, a pair of compression chambers P having decreased volume toward the center of the scrolls is formed. A refrigerant is sucked into the suction space 130 of the casing 100 through the suction pipe 110, and is sucked to an outermost compression chamber through the outlet 430 of the fixed scroll 400. Then, the refrigerant is compressed while moving towards a final compression chamber, and is discharged into the discharge space 140 of the casing 100. The refrigerant opens the check valve 830 provided at an entrance of the valve housing 810 by pushing, moves into the discharge pipe 140 through the refrigerant passing hole 821 of the valve seat 820, and is discharged from the compressor.

The process for opening and closing the check valve will be explained in detail herein below.

Figure 8A:
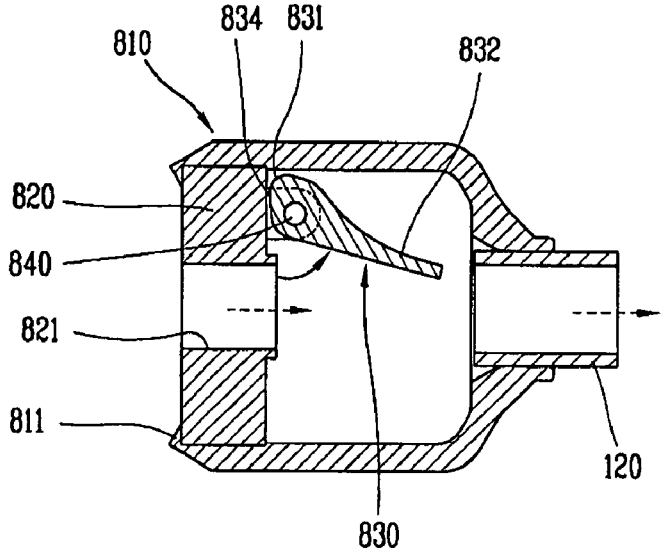
FIG. 8A is a longitudinal sectional view showing the backflow preventing apparatus of FIG. 4 when the compressor is normally operated.

As shown in FIG. 8A, when the compressor is normally operated, a discharge pressure of a refrigerant applied to a front surface of the check valve 830 is greater than the sum of the pressure applied to a rear surface of the check valve 830 and the pressure due to the weight of the check valve 830. Accordingly, the check valve 830 is opened by upwardly rotating around the hinge pin 840. The refrigerant compressed through the refrigerant passing hole 821 is quickly discharged to the discharge pipe 120. Since the valve stopping surface 834 having a predetermined inclination angle ($\alpha$) is formed on an outer circumferential surface of the hinge portion 831 of the check valve 830, it comes into contact with the valve seat 820, thereby limiting an opened angle of the check valve 830.

Figure 8B:
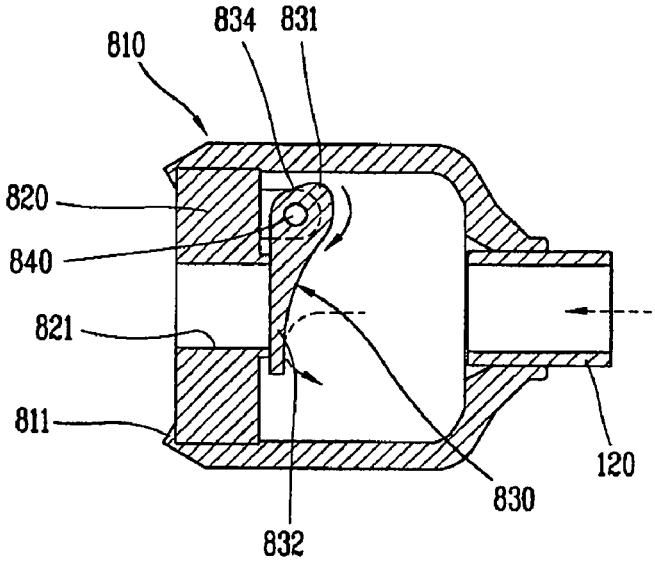
FIG. 8B is a longitudinal sectional view showing the backflow preventing apparatus of FIG. 4 when the compressor is stopped.

In contrast, as shown in FIG. 8B, when the compressor is abnormally operated or stopped, a discharge pressure of a refrigerant applied to the front surface of the check valve 830 is less than the sum between the pressure applied to the rear surface of the check valve 830 and the pressure due to the weight of the check valve 830. Accordingly, the check valve 830 is closed by downwardly rotating around the hinge pin 840. In this position, the front surface of the check valve 830 is in linear-contact with the sealing protrusion 824 of the valve seat 820, thereby preventing the refrigerant discharged into the discharge pipe 120 from backflowing into the discharge space 140. As shown in FIG. 6, when the buffering member 825 is disposed in the valve seat 820, the discharge valve 830 is elastically buffered by the buffering member 825. The buffering member 825 prevents or reduces collision noise or damage to the check valve, and refrigerant backflow is effectively prevented as the buffering member 825 is in linear-contact with the discharge valve 830.

As the check valve is hinge-coupled to the valve seat, the check valve has a quick response speed when opened and closed. When the check valve is closed, it is quickly closed by the pressure difference between both sides thereof and its own weight. Accordingly, discharged refrigerant may be effectively prevented from backflowing, and thus efficiency of the scroll compressor may be enhanced.

Further, collision noise of the check valve may be reduced when the check valve is opened and closed, thereby reducing discharge noise of the compressor. When the check valve is opened, it is prevented from colliding with other components by the valve stopping surface. Also, when the check valve is closed, noise that occurs when the discharge valve collides with the valve seat is reduced by the buffering member provided at the valve seat. Accordingly, discharge noise of the compressor may be reduced.

The backflow preventing apparatus according to another embodiment will be explained herein below.

In the previously disclosed embodiment, the check valve 830 is implemented as a hinge type valve. However, in this embodiment, the check valve 861 may be implemented as a read type valve.

Figure 11:
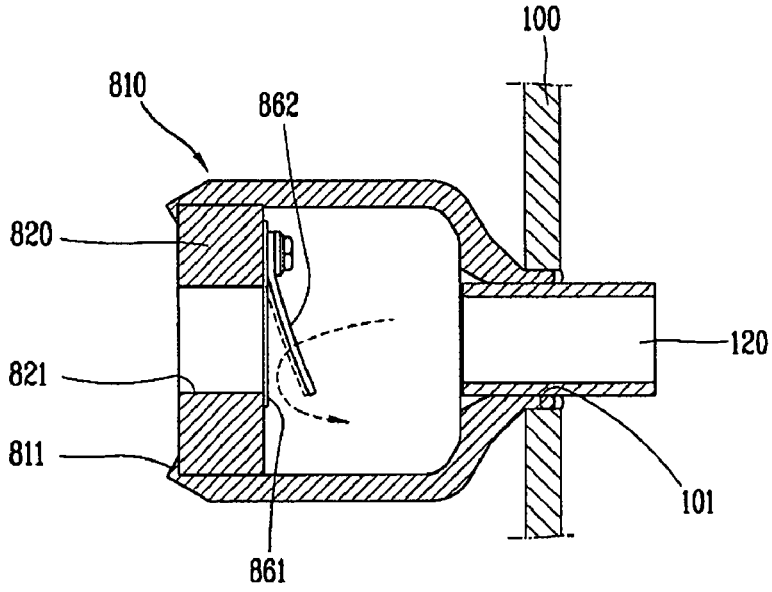
FIG. 11 is a longitudinal sectional view showing a check valve of a backflow preventing apparatus according to another embodiment.

The check valve 861 may be formed of a thin metallic plate having its own elasticity, as shown in FIG. 11. One end of the check valve 861 may have a fixed end fixedly-coupled to the valve seat 820, and another free end for opening and closing the refrigerant passing hole 821 of the valve seat 820 by freely rotating centered around the fixed end to a bent state. The check valve 861 may have an opened degree limited by its own elastic force, by an inner circumferential surface of the valve housing 810, or by additionally disposing a retainer 862 at the rear surface of the check valve 830.

Construction and operation of the valve housing 810 and the valve seat 820 of the backflow preventing apparatus are the same as those of the aforementioned embodiment, and thus their detailed explanation will be omitted. When the check valve 861 is opened, noise may be generated as the check valve 861 collides with the retainer 862. However, if the retainer 862 is formed to have a curved surface in correspondence to an opened shape of the check valve, the collision noise may be reduced.

An installation position of the backflow preventing apparatus according to embodiments may be varied as follows.

Figure 12:
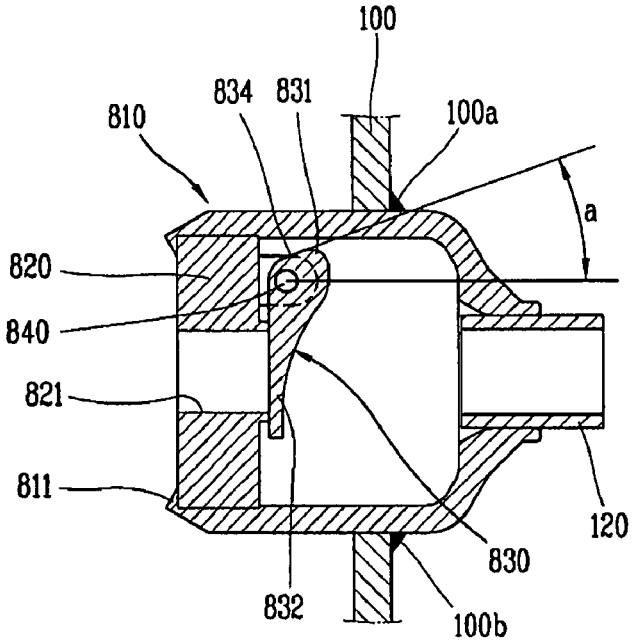
FIGS. 12 to 14 are longitudinal sectional views showing each installation position of a backflow preventing apparatus according to another embodiment.

As shown in FIG. 12, the valve housing 810 may be penetratingly-coupled to the casing 100, for example, by one or more weldings 100*a*, 100*b*. The valve housing 810 may be disposed on an outer surface of the casing 100, as shown in FIG. 13, or may be insertion-coupled to a discharge plenum 900 coupled to the fixed scroll 410, as shown in FIG. 14.

Referring to FIG. 12, when the valve housing 810 penetrates the casing 100, an outer circumferential surface of the valve housing 810 penetrates the through hole 101 of the casing 100, and is coupled to the casing by, for example, welding. With this configuration, the backflow preventing apparatus may be assembled even after the casing 100 is assembled.

Figure 13:
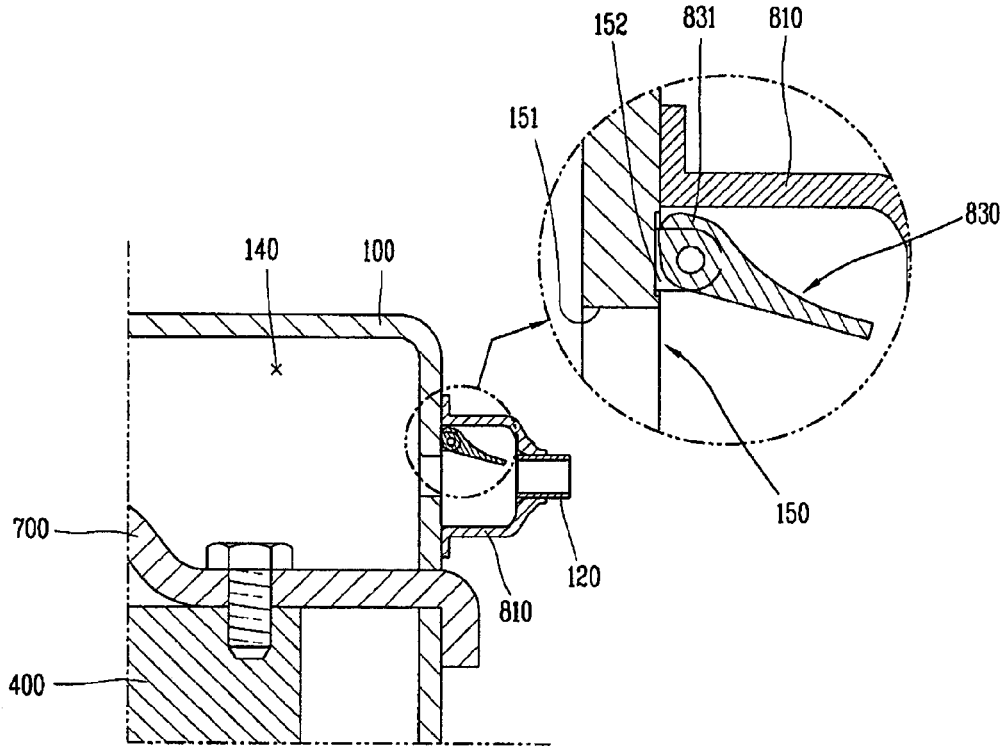

Referring to FIG. 13, when the valve housing 810 is disposed on an outer surface of the casing 100, a valve seat portion 150 having a refrigerant passing hole 151 may be integrally formed in the casing 100. Also, the hinge protrusion 152 for rotatably coupling the hinge portion 831 of the check valve 830 may be disposed above the refrigerant passing hole 151. An entrance of the valve housing 810 receives the check valve 830 thus to be hermetically-coupled to an outer surface of the casing 100, and the discharge pipe 120 may be connected to an exit of the valve housing 810. Since an additional valve seat for fixing the check valve 830 is not required, the number of components and the number of assembly processes may be reduced. Accordingly, a manufacturing cost may be reduced and productivity enhanced.

Figure 14:
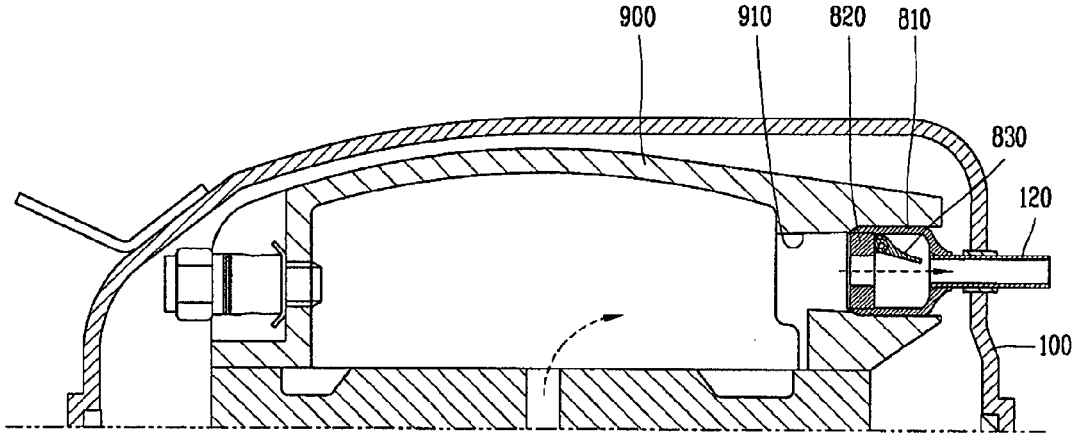

Referring to FIG. 14, when the valve housing 810 is coupled to a discharge plenum 900 that forms the discharge space, the valve housing 810 may be insertion-coupled to a through hole 910 of the discharge plenum 900. Also, the discharge pipe 120 connected to the exit of the valve housing 810 may be penetratingly-coupled to the casing 100 sealed to an outer surface of the discharge plenum 900. With this configuration, since the inner space of the casing 100 except the discharge plenum 900 forms a suction space of low pressure, a welding portion between the casing 100 and the discharge pipe 120 may receive less pressure, thus enhancing a sealing force. Also, since the discharge plenum 900 serves as a muffler, noise from the compressor may be reduced. The valve housing 810 may be adhered to an inner wall surface of the discharge plenum 900.

Figure 15:
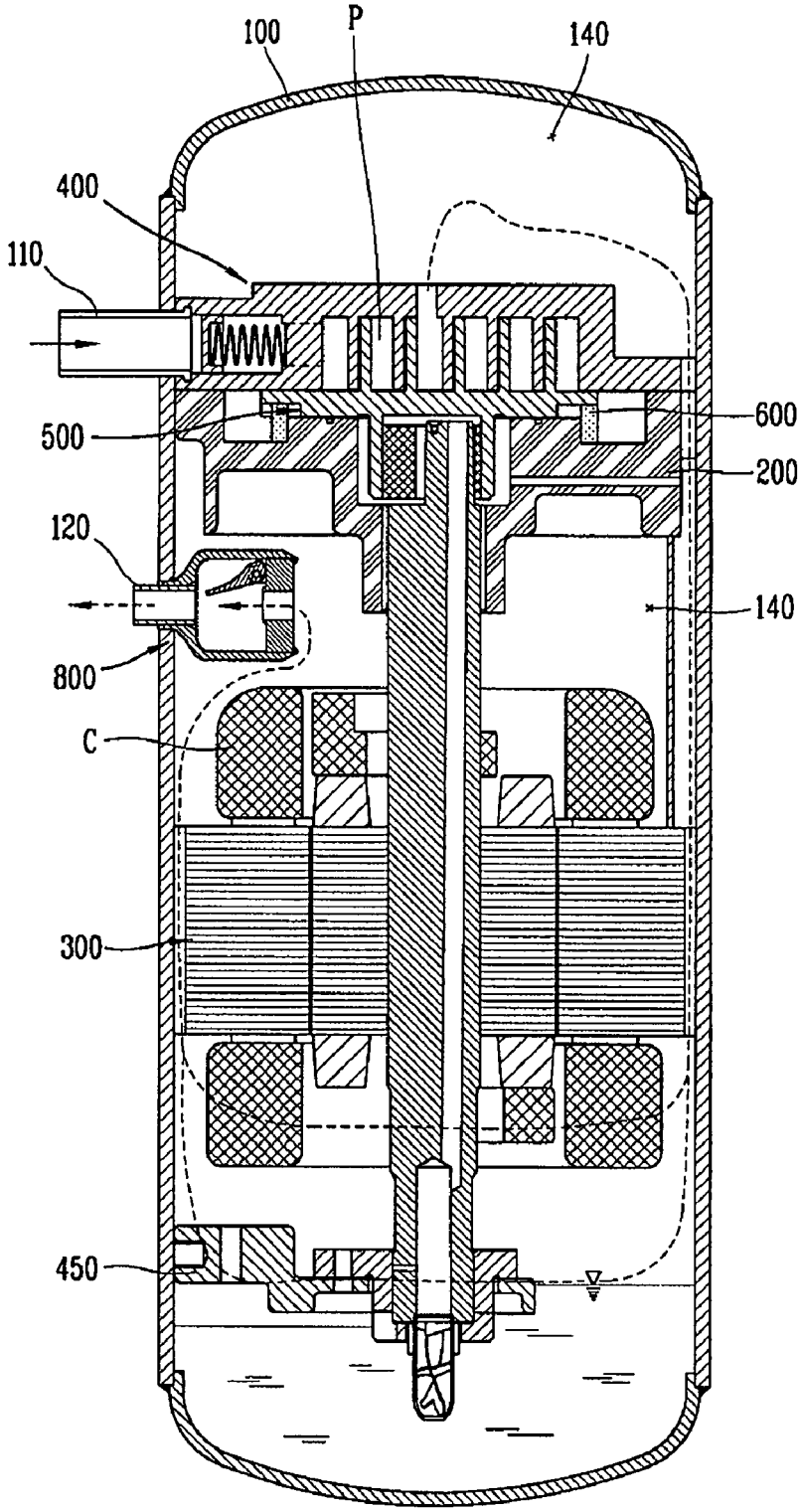
FIG. 15 is a longitudinal sectional view showing a high-pressure type scroll compressor having a backflow preventing apparatus according to an embodiment.

In the aforementioned embodiment, the backflow preventing apparatus was applied to a low pressure type scroll compressor in which the inner space of the casing is divided into a suction space and a discharge space by the high-low pressure separating plate or the discharge plenum. However, as shown in FIG. 15, the backflow preventing apparatus may be applied to a high pressure type scroll compressor in which the suction pipe 110 is directly coupled to the fixed scroll 400 by penetrating the casing 100, the inner space of the casing 100 maintains the discharge space 140 of a high pressure, and the discharge pipe 120 is connected to the discharge space 140. That is, the backflow preventing apparatus, such as the hinge type valve or the read type valve according to embodiments disclosed herein, is disposed between the discharge space 140 and the discharge pipe 120. Operation of the high-pressure type scroll compressor is the same as that of the low-pressure type scroll compressor, and thus its detailed explanation will be omitted.

Embodiments disclosed herein provide a backflow preventing apparatus for a compressor, such as a scroll compressor, capable of enhancing a performance of the compressor by quickly closing a check valve, enhancing a responsive characteristic of the check valve, and preventing a refrigerant from backflowing.

Embodiments disclosed herein also provide a backflow preventing apparatus for a compressor, such as a scroll compressor, capable of lowering vibration noise of the compressor by reducing collision noise that occurs when the check valve is opened and closed.

The backflow preventing apparatus for a compressor, such as a scroll compressor, includes a valve housing disposed between an inner space of a hermetic casing and a discharge pipe communicated with the inner space, a valve seat disposed at the valve housing and having a refrigerant passing hole so that the inner space of the casing and the discharge pipe can communicate with each other, and a check valve rotatably coupled to the valve seat, that opens and closes the refrigerant passing hole of the valve seat.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A backflow preventing apparatus for a compressor, comprising:

a valve housing configured to be disposed between an inner space of a casing of the compressor and a discharge pipe that communicates with the inner space;

a valve seat disposed in the valve housing and having a refrigerant passing hole through which the inner space of the casing and the discharge pipe communicate with each other; and a check valve rotatably coupled to the valve seat and configured to open and close the refrigerant passing hole of the valve seat, wherein the valve housing, the valve seat, the check valve, and the discharge pipe are integrally coupled to one another, wherein the check valve has a hinge portion configured to be hinge-coupled to the valve seat at one end thereof, and an opening/closing portion for opening and closing the refrigerant passing hole of the valve seat at another end thereof, the hinge portion positioned above or adjacent to the opening/closing portion, and wherein a valve stopping surface that limits an opened angle of the check valve, by coming into contact with a fixed surface of the valve seat when the check valve is opened, is formed on the hinge portion of the check valve.

2. The apparatus of claim 1, wherein the opening/closing portion has a plate shape.

3. The apparatus of claim 1, wherein a size of the check valve becomes smaller from the opening/closing portion to the hinge portion.

4. The apparatus of claim 1, wherein a hinge hole is disposed in the check valve, and at least one hinge hole for inserting a hinge pin therethrough is disposed in the valve seat corresponding to the hinge hole of the check valve.

5. The apparatus of claim 1, wherein the check valve is disposed so that a center of the hinge portion is positioned nearer to a discharge side of a refrigerant than a front surface of the check valve, or is disposed so that the center of the hinge portion is at the same position as the front surface of the check valve.

6. The apparatus of claim 1, further comprising a buffering member disposed on the value seat at a portion to which the front surface of the check valve contacts when the check valve is closed.

7. The apparatus of claim 1, wherein the valve seat is coupled to the valve housing by one of a forcible-insertion method, a welding method, or a bolting method.

8. The apparatus of claim 1, wherein the valve housing is configured to be disposed at in the inner space of the casing and coupled to an inner circumferential surface of the casing.

9. The apparatus of claim 1, wherein the valve housing is configured to be disposed in the inner space of the casing, and a connection portion between the valve housing and the discharge pipe insertion-coupled to the casing.

10. The apparatus of claim 1, wherein the valve housing is configured to be coupled to the casing by penetrating a wall surface of the casing.

11. The apparatus of claim 1, wherein one end of the valve housing is configured to be coupled to an outer wall surface of the casing, and the valve seat disposed in the outer wall surface of the casing.

12. The apparatus of claim 1, wherein the valve housing is configured to be coupled to a discharge plenum that receives a discharged refrigerant disposed in the inner space of the casing.

13. The apparatus of claim 1, further comprising:

an elastic member that asserts a predetermined bias force in a direction that opposes a direction of flow of refrigerant from the refrigerant passing hole to the discharge pipe.

14. The apparatus of claim 1, wherein the valve stopping surface on the hinge portion is formed at a predetermined oblique angle relative to a surface of the opening/closing portion of the check valve, the valve stopping surface being substantially parallel to and in contact with a surface of the valve seat to limit the opened angle of the check valve.

15. The apparatus of claim 14, wherein the check value is oriented at an inclined angle relative to an axis passing through a center of the refrigerant passing hole in the valve seat, the check value oriented at said inclined angle when the valve stopping surface is substantially parallel to and in contact with the surface of the valve seat that limits the opened angle of the check valve.

16. A compressor, comprising:

a casing forming an inner space;

a drive configured to drive one scroll with respect to another scroll to thereby compress a refrigerant, at least one compression chamber formed in the inner space of the casing;

a suction space to which a suction pipe is connected in communication with the at least one compression chamber;

a discharge space to which a discharge pipe is connected in communication with the at least one compression chamber; and a backflow preventing apparatus, comprising:

a valve housing configured to be disposed between the inner space of the casing and the discharge pipe;

a valve seat disposed in the valve housing and having a refrigerant passing hole through which the inner space of the casing and the discharge pipe communicate with each other; and a check valve rotatably coupled to the valve seat and configured to open and close the refrigerant passing hole of the valve seat, and a buffering member disposed on the value seat at a portion to which a front surface of the check valve contacts when the check valve is closed, wherein the check valve has a hinge portion configured to be hinge-coupled to the valve seat at one end thereof, and an opening/closing portion for opening and closing the refrigerant passing hole of the valve seat at another end thereof, the hinge portion positioned above or adjacent to the opening/closing portion, and wherein the valve housing, the valve seat, the check valve, and the discharge pipe are integrally coupled to one another.

17. The apparatus of claim 16, wherein the valve housing is configured to be disposed at in the inner space of the casing and coupled to an inner circumferential surface of the casing.

18. The apparatus of claim 16, wherein the valve housing is configured to be disposed in the inner space of the casing, and a connection portion between the valve housing and the discharge pipe insertion-coupled to the casing.

19. The apparatus of claim 16, wherein the valve housing is configured to be coupled to the casing by penetrating a wall surface of the casing.

20. The apparatus of claim 16, wherein one end of the valve housing is configured to be coupled to an outer wall surface of the casing, and the valve seat disposed in the outer wall surface of the casing.

21. The apparatus of claim 16, wherein the valve housing is configured to be coupled to a discharge plenum that receives a discharged refrigerant disposed in the inner space of the casing.

22. The apparatus of claim 16, wherein a valve stopping surface that limits an opened angle of the check valve by coming into contact with a fixed surface of the valve seat when the check valve is opened is formed on a rear surface of the hinge portion of the check valve.

23. The apparatus of claim 16, further comprising a buffering member disposed on the value seat at a portion to which the front surface of the check valve contacts when the check valve is closed.

24. The apparatus of claim 16, wherein the opening/closing portion has a plate shape.

25. The apparatus of claim 16, wherein the check valve is formed to be thinner towards the opening/closing portion from the hinge portion.

26. The apparatus of claim 16, wherein a hinge hole is disposed in the check valve, and at least one hinge hole for inserting a hinge pin therethrough is disposed in the valve seat corresponding to the hinge hole of the check valve.

27. The apparatus of claim 16, wherein the check valve is disposed so that a center of the hinge portion is positioned nearer to a discharge side of a refrigerant than a front surface of the check valve, or is disposed so that the center of the hinge portion is at the same position as the front surface of the check valve.

28. The apparatus of claim 16, wherein the valve seat is coupled to the valve housing by one of a forcible-insertion method, a welding method, or a bolting method.

* * * * *